US010378201B2

(12) United States Patent
Coombes et al.

(10) Patent No.: US 10,378,201 B2
(45) Date of Patent: Aug. 13, 2019

(54) COLLAPSIBLE MODULAR BUILDING

(71) Applicant: Troy Coombes, Taber (CA)

(72) Inventors: Troy Coombes, Taber (CA); Simon A Hann, Lethbridge (CA); Jay A Huson, Lethbridge (CA); Christopher J. R. Tinis, Lethbridge (CA)

(73) Assignee: Troy Coombes, Taber (CA)

( * ) Notice: Subject to any disclaimer, the term of this patent is extended or adjusted under 35 U.S.C. 154(b) by 0 days.

(21) Appl. No.: 15/295,194

(22) Filed: Oct. 17, 2016

(65) Prior Publication Data

US 2018/0106031 A1 Apr. 19, 2018

(51) Int. Cl.

| | |
|---|---|
| ***E04B 1/343*** | (2006.01) |
| ***B66C 17/00*** | (2006.01) |
| ***E04B 1/342*** | (2006.01) |
| ***E04B 1/344*** | (2006.01) |
| ***E04B 1/348*** | (2006.01) |
| ***E04B 7/16*** | (2006.01) |

(52) U.S. Cl.

CPC ..... *E04B 1/34331* (2013.01); *B66C 17/00* (2013.01); *E04B 1/342* (2013.01); *E04B 1/3445* (2013.01); *E04B 1/34321* (2013.01); *E04B 1/34357* (2013.01); *E04B 1/34384* (2013.01); *E04B 1/34807* (2013.01); *E04B 7/166* (2013.01); *E04B 2001/34394* (2013.01)

(58) Field of Classification Search

CPC ..... E04H 2003/142; E04H 2003/147; E04H 2001/1283; E04H 3/126; E04H 3/165; E04B 1/342; E04B 1/34336; E04B 1/34357; E04B 1/34363; E04B 1/34373; E04B 1/34384; E04B 1/344; E04B 1/3442; E04B 1/3444; E04B 1/348; E04B 1/3445; E04B 1/34321; E04B 1/34807

USPC ..... 52/68, 69, 70, 71, 79.14, 79.5, 79.9

See application file for complete search history.

(56) References Cited

U.S. PATENT DOCUMENTS

| | | | | | |
|---|---|---|---|---|---|
| 3,765,556 | A | * | 10/1973 | Baer | B65D 88/022 220/1.5 |
| 3,849,952 | A | * | 11/1974 | Hanaoka | E04B 1/3445 52/426 |
| 3,961,712 | A | * | 6/1976 | Bartley | B66C 17/00 212/315 |
| 4,200,419 | A | | 4/1980 | Rogers | |
| 4,603,518 | A | | 8/1986 | Fennes | |
| 4,633,626 | A | * | 1/1987 | Freeman | E04B 1/34315 52/126.6 |
| 4,779,514 | A | * | 10/1988 | Prigmore | E04B 1/3445 52/79.5 |
| 4,854,094 | A | | 8/1989 | Clark | |

(Continued)

FOREIGN PATENT DOCUMENTS

| | | | | | |
|---|---|---|---|---|---|
| WO | WO-2014142824 | A1 | * | 9/2014 | E04B 1/3445 |

*Primary Examiner* — Jessica L Laux

(74) *Attorney, Agent, or Firm* — Lewellyn Law, PLLC; Stephen Lewellyn

(57) ABSTRACT

A collapsible modular building is constructed from at least two building modules that are joined together to form the building. Each building module is constructed to be configured in either a collapsed or erect position. In the collapsed position, each module is individually transported to a site by trailer. Once offloaded, the modules are joined together to form the building, this joining together of the modules can be done while the modules are in the collapsed position or in the erect position.

5 Claims, 22 Drawing Sheets

(56) References Cited

U.S. PATENT DOCUMENTS

| | | | | |
|---|---|---|---|---|
| 5,154,469 | A | 10/1992 | Morrow | |
| 6,003,919 | A | 12/1999 | Shook | |
| 6,712,414 | B2 | 3/2004 | Morrow | |
| 7,540,390 | B2 * | 6/2009 | Bublitz | B65D 88/14 220/1.5 |
| 8,112,943 | B2 | 2/2012 | Medley | |
| 8,371,091 | B2 | 2/2013 | Graf | |
| 8,484,908 | B2 | 7/2013 | Hache | |
| 2002/0129566 | A1 | 9/2002 | Piccolo et al. | |
| 2006/0225369 | A1 | 10/2006 | Napier | |
| 2007/0170740 | A1 | 7/2007 | Di Franco | |
| 2009/0134663 | A1 | 5/2009 | Hickam et al. | |
| 2010/0192481 | A1 | 8/2010 | Shen et al. | |
| 2012/0180404 | A1 * | 7/2012 | Scouten | E04B 1/34321 52/79.5 |
| 2014/0144088 | A1 * | 5/2014 | Heger | E04B 1/34357 52/79.5 |
| 2014/0298745 | A1 | 10/2014 | Rechenmacher et al. | |
| 2016/0059105 | A1 * | 3/2016 | Scade Garcia | E04H 1/12 52/69 |

* cited by examiner

COLLAPSIBLE MODULAR BUILDING

FIELD OF THE INVENTION

The present invention relates generally to modular buildings, and more particularly, relating to a modular building constructed of building modules having a liftable roof, extensible walls, and an overhead crane structure.

BACKGROUND OF THE INVENTION

Conventionally, modular buildings are constructed off-site and consist of multiple sections called modules that are transported to a building site where the modules are joined together to form the building. The modules may be designed to be placed side-by-side, end-to-end, or stacked, thereby providing large flexibility in building design. While many different designs and structures of modular buildings exist, none heretofore have been suitable for oversized building constructions, such as, for example fabrication facilities. Accordingly, there is a need for an improved modular building that overcomes the drawbacks of existing modular buildings.

SUMMARY OF THE INVENTION

In view of the foregoing problems with existing modular buildings, embodiments of the present invention provide a new modular building construction suitable for constructing oversized buildings.

In general, in one aspect, a modular building is provided. The modular building includes at least two building modules connected to one another, forming the building. Each of building module has a base having opposite first and second longitudinal sides and opposite first and second lateral sides; a roof having opposite first and second longitudinal sides and opposite first and second lateral sides; a first articulated wall connected to and extending between the base and the roof and extending along the first longitudinal sides of the base and the roof; and a second articulated wall connected to and extending between the base and the roof and extending along the second longitudinal sides of the base and the roof. Each of the first and the second articulated walls fold in a direction inwardly toward one another into a collapsed position wherein the roof is moved toward the base and fold in a direction outward from one another into an extended position wherein the roof is moved away from the base. The roof of each the at least two building modules are connected together and the base of each of the at least two building modules are connected together.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages, and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
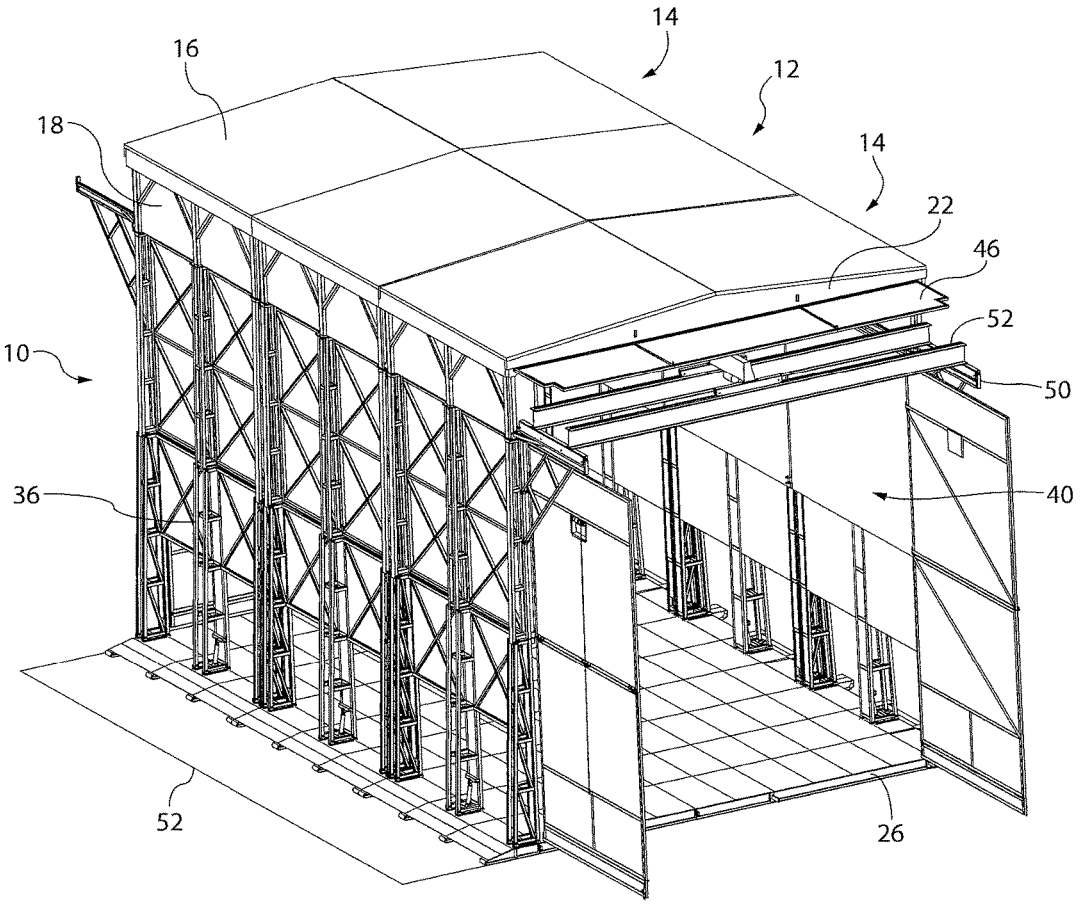
FIG. 1 is a front perspective view of a collapsible modular building that is constructed in accordance with the principles of an embodiment of the present invention, illustrating an overhead crane supported by an exterior support structure and doors in an open position.
Figure 2:
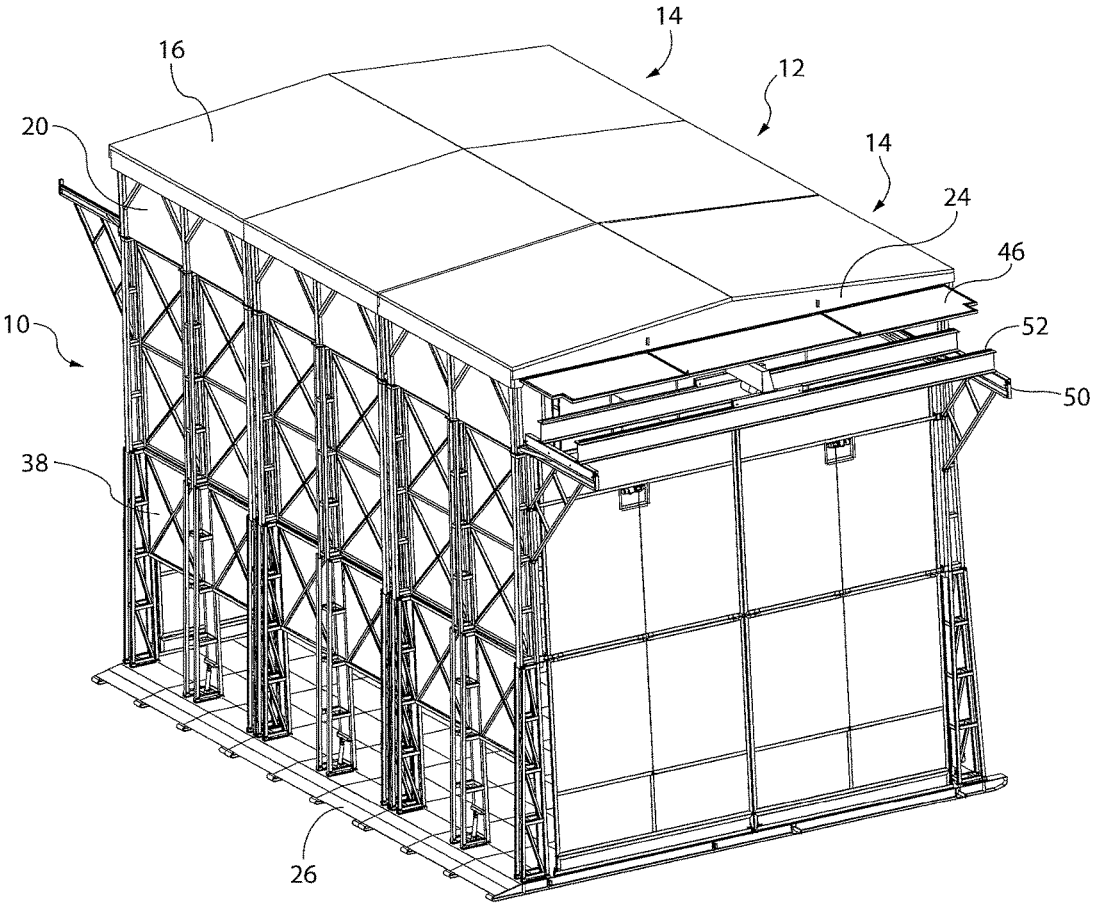
FIG. 2 is a rear perspective view of a collapsible modular building shown in FIG. 1 that is constructed in accordance with the principles of an embodiment of the present invention, illustrating an overhead crane supported by an exterior support structure and doors in a closed position.
Figure 3:
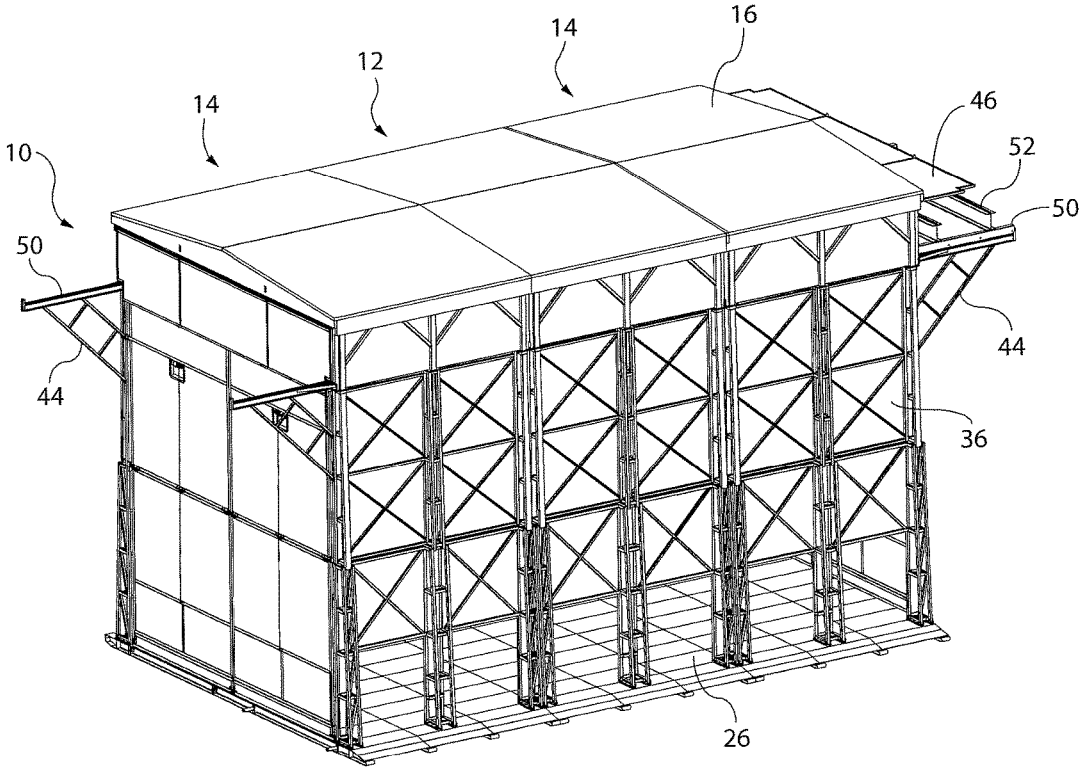
FIG. 3 is a rear perspective view of a collapsible modular building that is constructed in accordance with the principles of an embodiment of the present invention.
Figure 4:
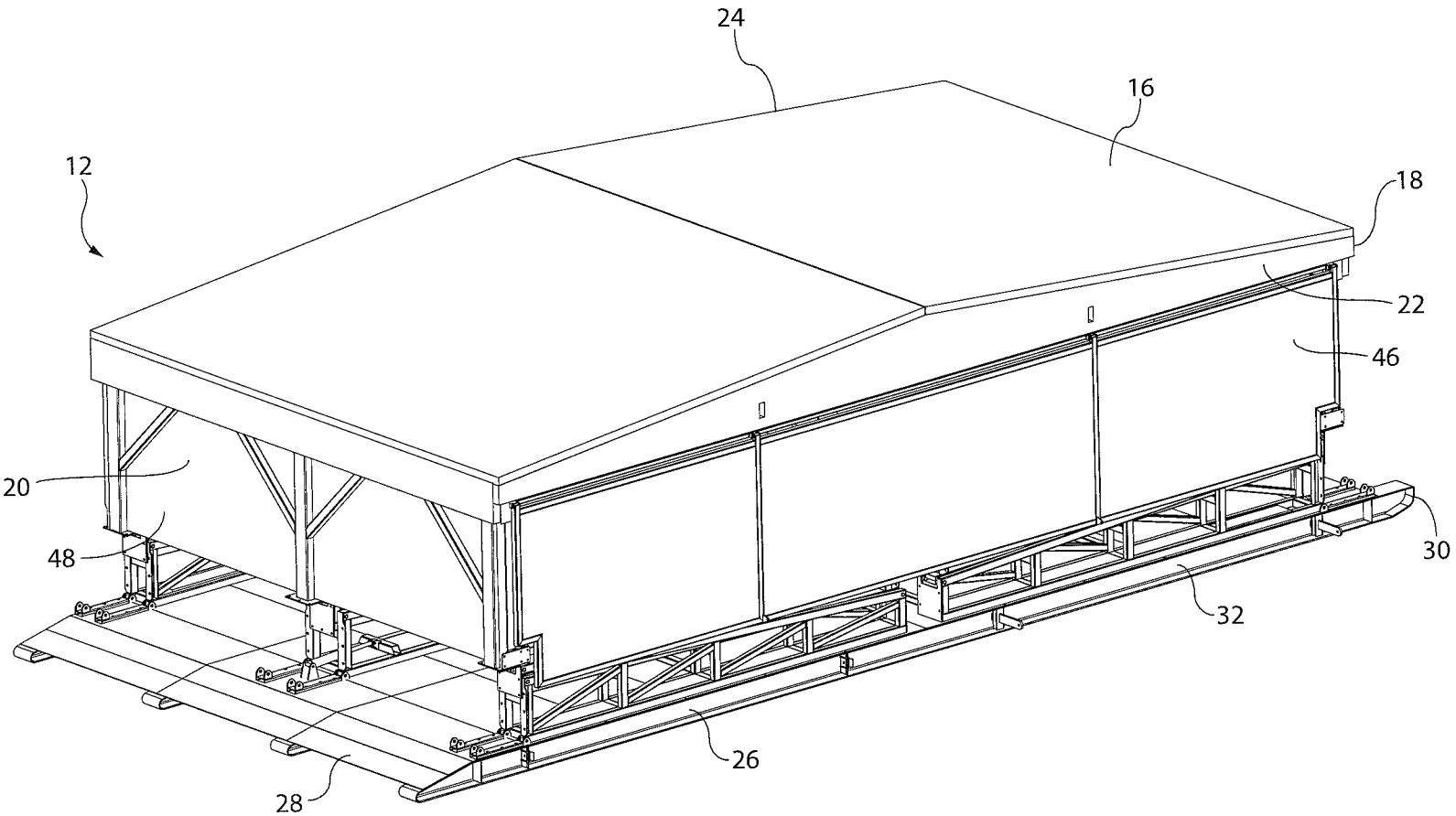
FIG. 4 is a perspective view of a type of a building module of a collapsible modular building that is constructed in accordance with the principles of an embodiment of the present invention, illustrating the building module in a collapsed, transportable position.
Figure 5:
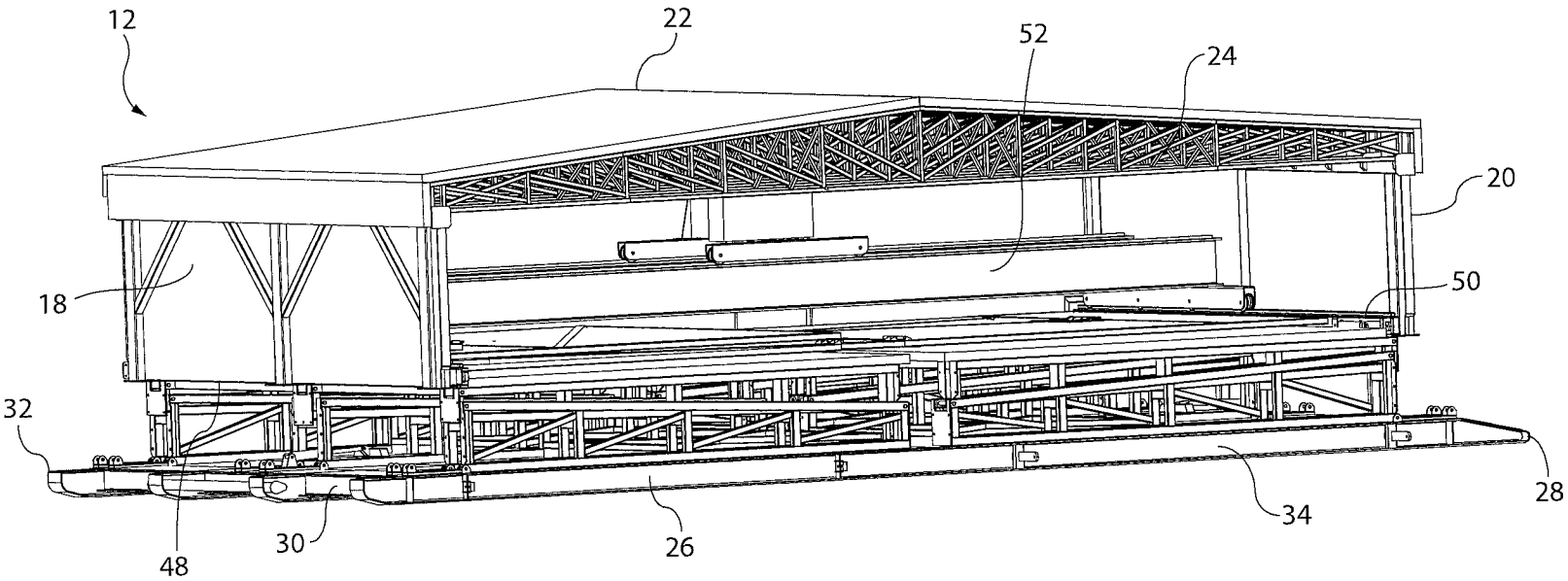
FIG. 5 is a perspective view of a type of a building module of a collapsible modular building that is constructed in accordance with the principles of an embodiment of the present invention, illustrating the building module in a collapsed, transportable position with an overhead crane located in a stored position.
Figure 6:
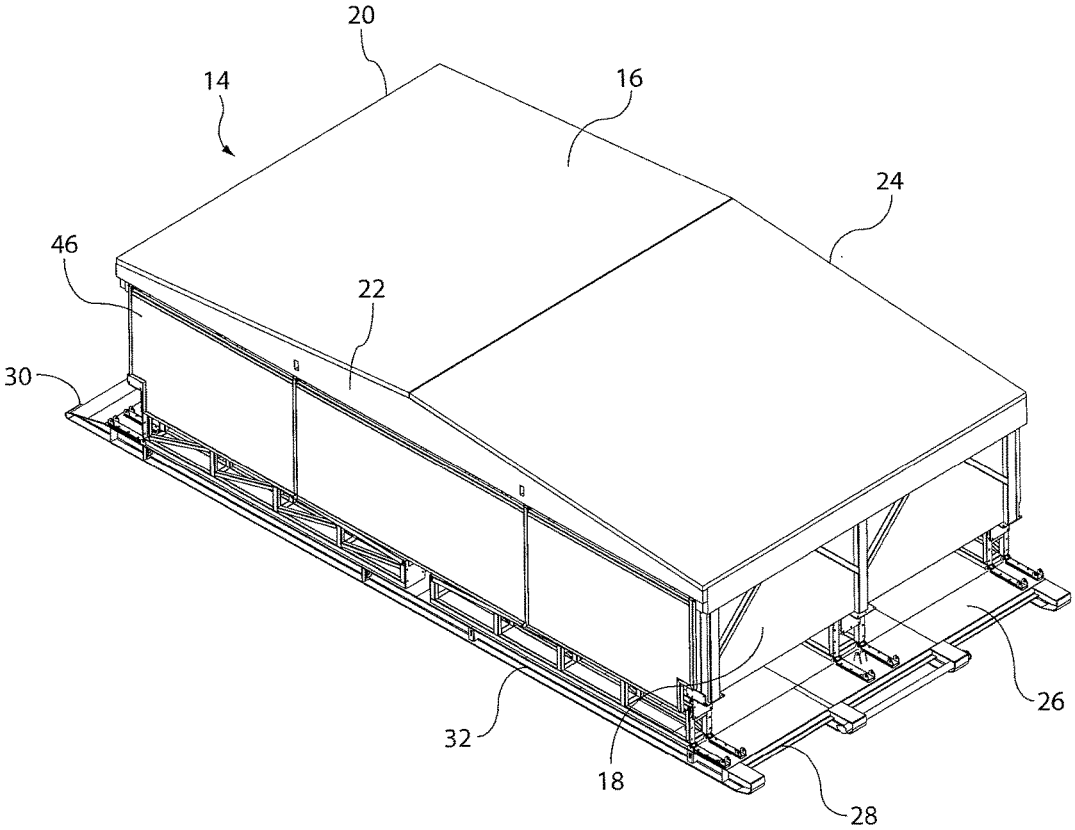
FIG. 6 is a perspective view of a type of a building module of a collapsible modular building that is constructed in accordance with the principles of an embodiment of the present invention, illustrating the building module in a collapsed, transportable position.

Referring now to FIGS. 1-23 of the drawings, and more particularly to FIGS. 1-3, shown therein and designated by reference number 10 is a collapsible modular building that is constructed in accordance with an embodiment of the present invention.

Figure 8:
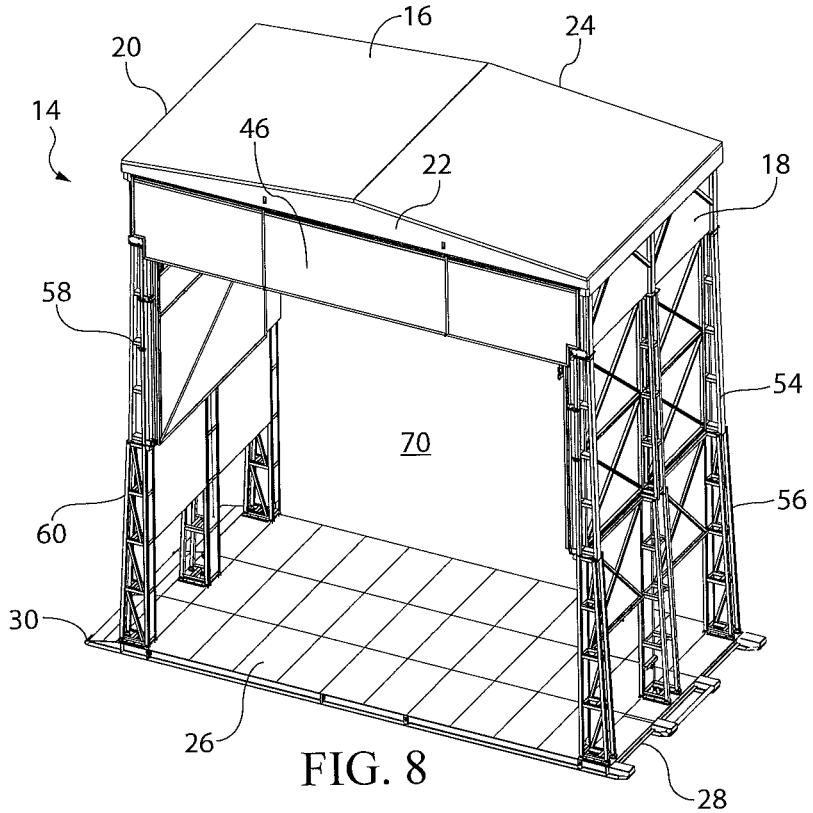
FIG. 8 is a perspective view of a type of a building module of a collapsible modular building that is constructed in accordance with the principles of an embodiment of the present invention, illustrating the end module in an erect position.
Figure 9:
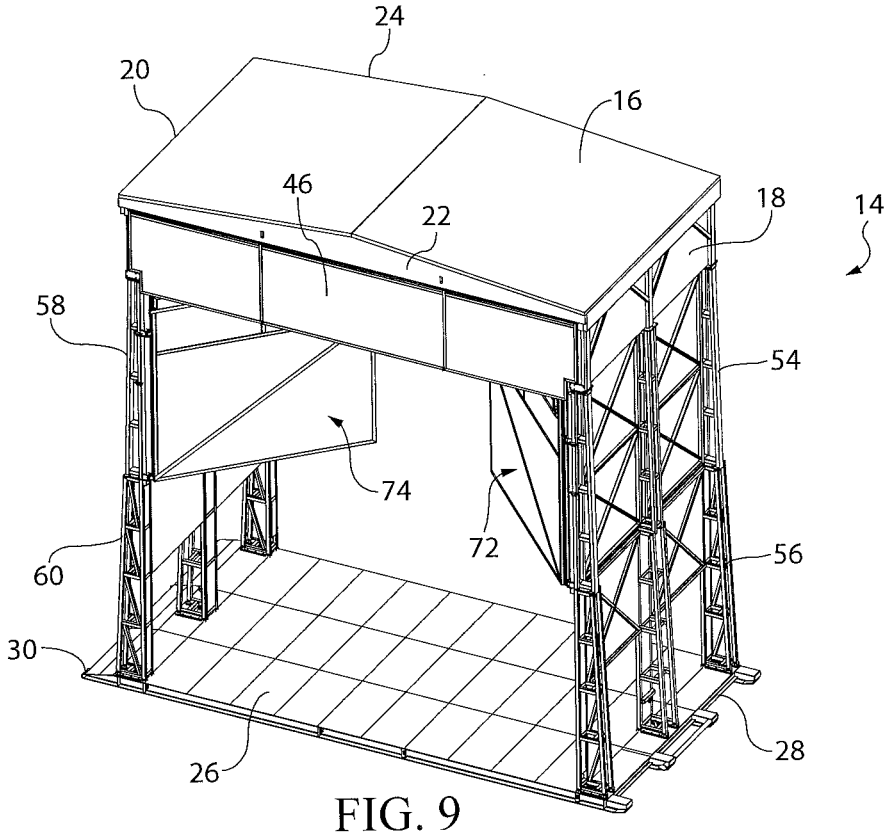
FIG. 9 is a perspective view of a type of a building module of a collapsible modular building that is constructed in accordance with the principles of an embodiment of the present invention, illustrating doors of the building module transitioning to a closed, folded position.
Figure 10:
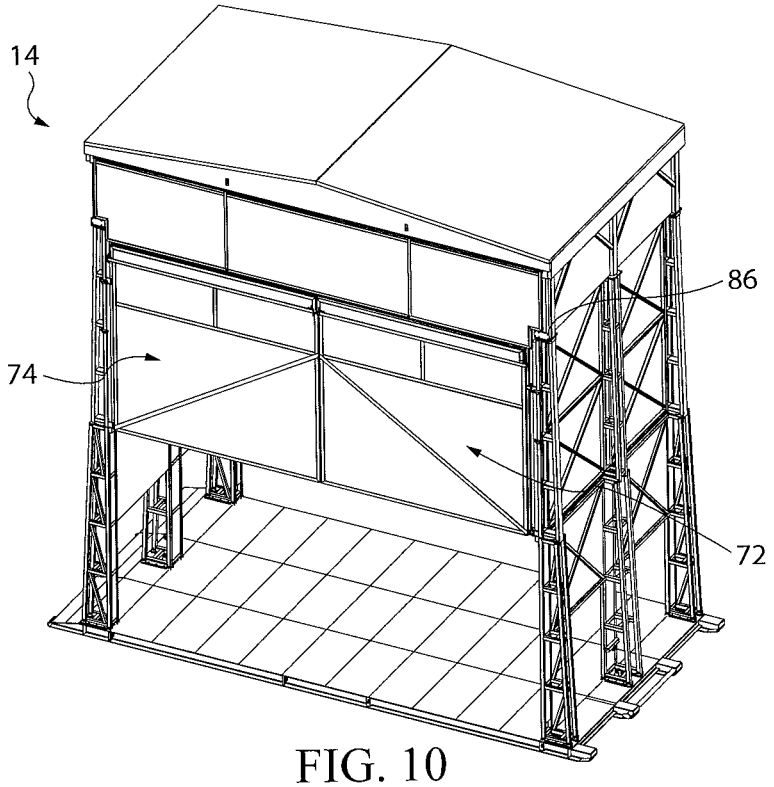
FIG. 10 is a perspective view of a type of a building module of a collapsible modular building that is constructed in accordance with the principles of an embodiment of the present invention, illustrating doors of the building module in a closed, folded position.
Figure 11:
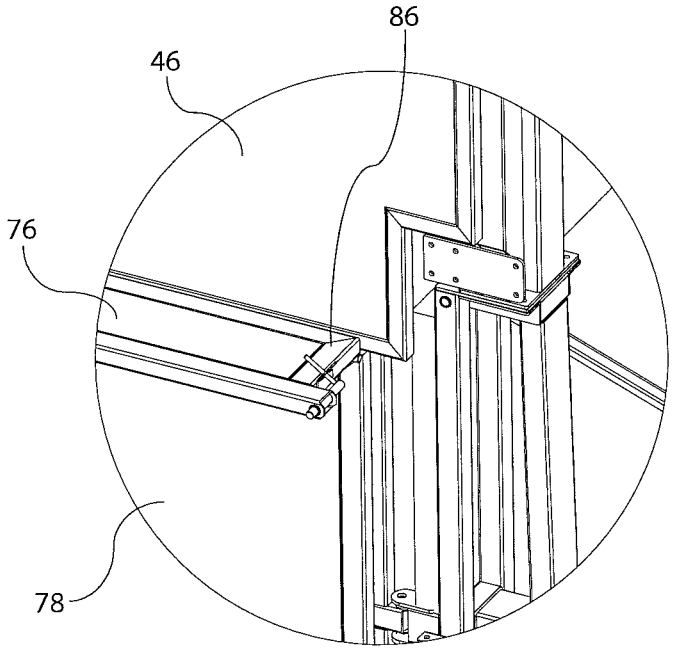
FIG. 11 is an enlarged partial perspective view of a collapsible modular building that is constructed in accordance with the principles of an embodiment of the present invention, illustrating a clip securing doors in a folded position.
Figure 12:
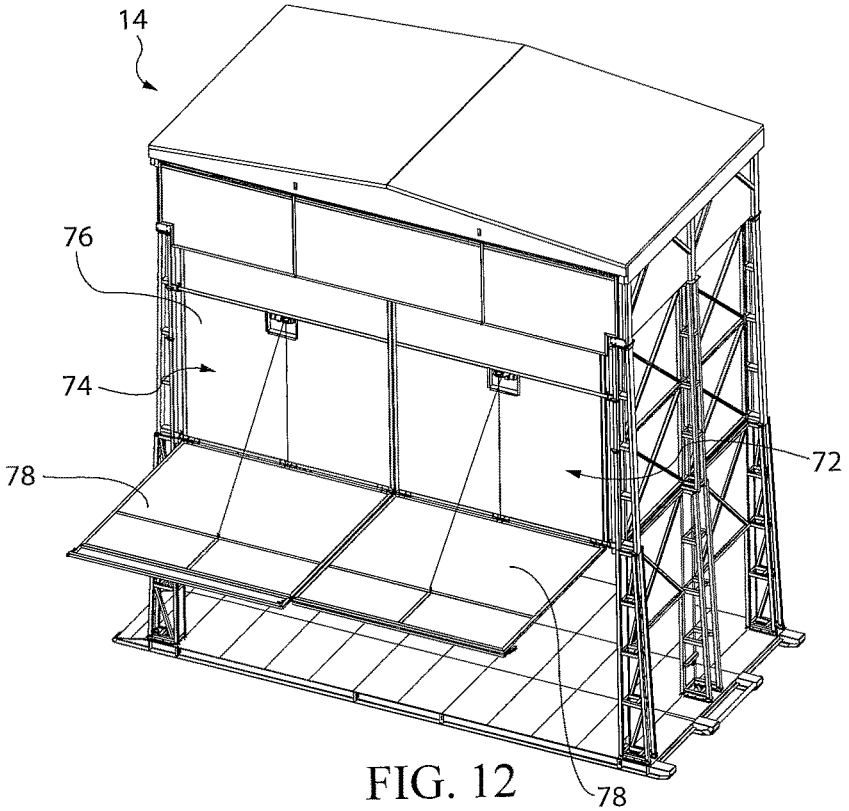
FIG. 12 is a perspective view of a type of a building module of a collapsible modular building that is constructed in accordance with the principles of an embodiment of the present invention, illustrating doors of the building module transitioning to an unfolded position.

In the depicted embodiment, the collapsible modular building 10 is constructed by a plurality of separate building modules joined together, representatively a central module 12 is disposed between and joined along opposite sides to two end modules 14. It should be understood the modular building 10 may include additional central modules 12 as desired to increase the size of the building 10. Alternatively, the modular building 10 may be constructed by adjoining two end modules 14 together without a central module 12. The central module 12 and end modules 14 are capable of transitioning from a collapsed, transportable position to an erect position, as best seen in FIGS. 8-10.

The central module 12 and end modules 14 each include a roof 16 having opposite first and second longitudinal sides 18, 20 and opposite first and second lateral sides 22, 24, a base 26 having opposite first and second longitudinal sides 28, 30 and opposite first and second lateral sides 32, 34, and opposite first and second articulated sidewalls 36, 38. The roof 16, base 26, and opposite first and second articulated sidewalls 36, 38 define a continuous interior space 40. When the modules 12, 14 are connected and in the erect position forming the collapsible modular building 10, the interior space 40 of building 10 extends uninterrupted. The building 10 is specifically designed to have the interior space 40 to allow large pieces of equipment to pass between end modules 14 and any number of central modules 12, as best seen in FIG. 2.

The end module 14 further includes a crane door 46 that extends along the first lateral side 22 of the roof 16, between the first longitudinal side 18 to the second longitudinal side 20. The crane door 46 is hingedly attached along the first lateral side 22 of the roof 16 and is configured to open away from the second lateral side 24 of roof 16.

The modules 12, 14 further include crane rails 50 that extend longitudinally along the bottom edge 48 first and second longitudinal sides 18, 20 of roof 16. When the modules 12, 14 are attached to form the collapsible modular building 10, the crane rails 50 are positioned end-to-end so as to extend along the length 52 of the collapsible modular building 10.

The collapsible modular building 10 further includes a crane 52 that is supported on each end by the crane rails 50, wherein the crane 52 can move longitudinally along the along the rails 50. When the building 10 is in the collapsed position, and the modules 12, 14 are detached from one another, crane 52 is stored within the end module 14 to facilitate transportation.

For illustrative purposes, FIGS. 6-13 illustrate the end module 14 transitioning from the collapsed position, to the erect position. It is important to understand that the central module 12 transitions from the collapsed position to the erect position using similar element, however, the central module 12 is best seen in the erect position in FIG. 16.

In the depicted embodiment, first articulated sidewall 36 hingedly connects to and extends between the first longitudinal side 18 of roof 16 and the first longitudinal side 28 of base 26 and includes an upper portion 54 and a lower portion 56. The upper and lower portions 54, 56 of the first articulated sidewall 36 are hingedly attached to one another and configured to fold along the first hinged attachment point 62. Similarly, second articulated sidewall 38 hingedly connects to and extends between the second longitudinal side 20 of roof 16 and the second longitudinal side 30 of base 26 and includes an upper portion 58 and a lower portion 60. The upper and lower portions 58, 60 of the second articulated sidewall 38 are hingedly attached to one another and configured to fold along the second hinged attachment point 64. The first and second hinged attachment points are configured to fold inwardly toward one another, thereby allowing the modules 12, 14 to transition to the collapsed position. The first and second hinged attachment points are also configured to fold outwardly away from one another to allow the modules 12, 14 to transition to the erect position.

To provide users with the ability to customize the collapsible modular building 10, the first and second articulated sidewalls 36, 38 include a wall panels 66, wherein the wall panels 66 are partially not included along the lower portions 56, 60 of the first and second articulated sidewalls 36, 38, thereby leaving a wall panel space 68. Once the modules 12, 14 are positioned on site and in the erect position, a user can choose to fill in the space 68 with various items, such as, but not limited to a standard user entry and exit door, overhead opening doors, or electrical panels.

Figure 17:
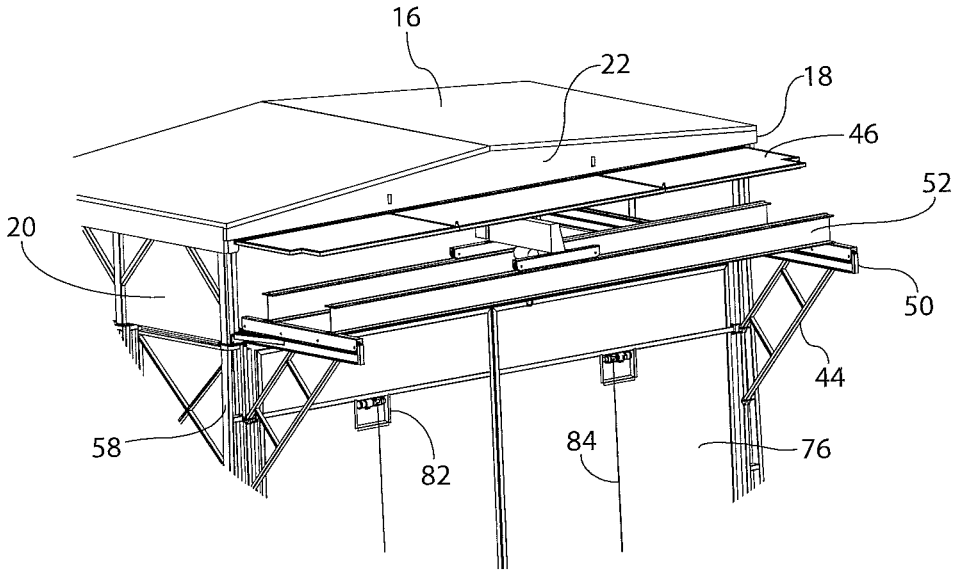
FIG. 17 is a partial perspective view of an exterior support structure for an overhead crane of a collapsible modular building that is constructed in accordance with the principles of an embodiment of the present invention, illustrating an overhead crane supported by an exterior support structure.

As best shown in FIG. 17, the end module 14 includes at least two exterior crane supports 44 vertically attached along the upper portions 54, 58 of the first and second articulated sidewalls 36, 38, are configured to include crane rails 50. When installed, the exterior crane supports 44 are positioned in a manner to allow the crane rails 50 to be positioned end-to-end with the crane rails 50 included within the end module 14. This allows crane 52 to transition from the interior space 15 of the collapsible modular building 10 to the exterior.

Once in the erect position, as shown in FIG. 8, the crane door 46, the first and second articulated sidewalls 36, 38, and base 26 define a door opening 70 extending along the first lateral side 32 of base 26. To fill this opening 70, end modules 14 further includes a first and a second door 72, 74 each including top, middle, and bottom panels 76, 78, 80. The top panels 76 of each door 72 and 74 are hingedly attached along the upper portions 54, 58 of each of the first and second articulated sidewalls 36, 38, as best illustrated in FIG. 9. The middle panels 78 of each of the first and second doors 72, 74 are hingedly attached along opposite edges, between the top panels 76 and the bottom panels 80.

Figure 13:
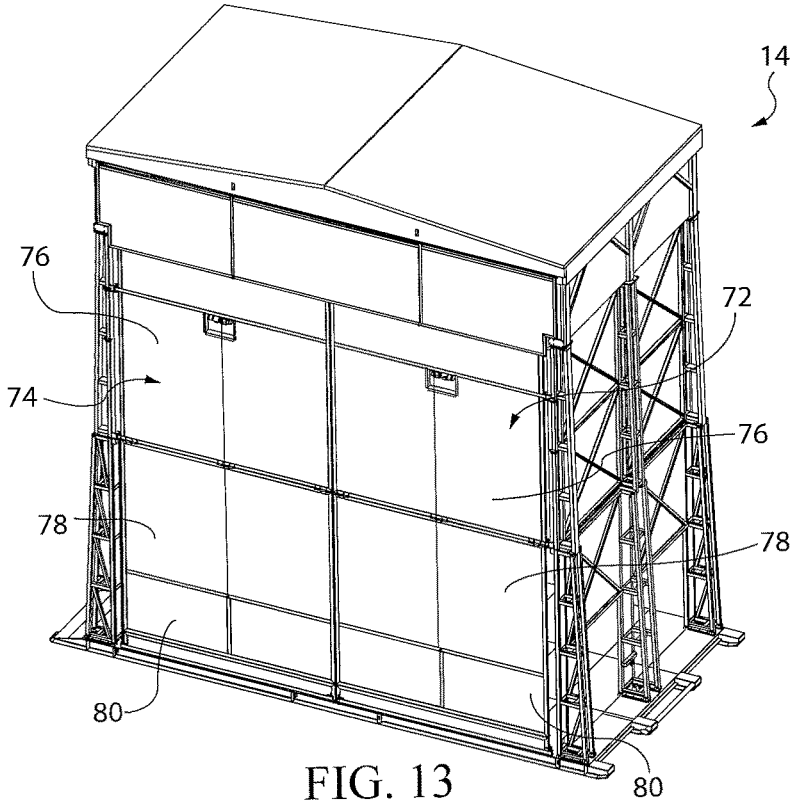
FIG. 13 is a perspective view of an end module of a collapsible modular building that is constructed in accordance with the principles of an embodiment of the present invention, illustrating the building module in an erect position and the doors in a closed, unfolded position.
Figure 14:
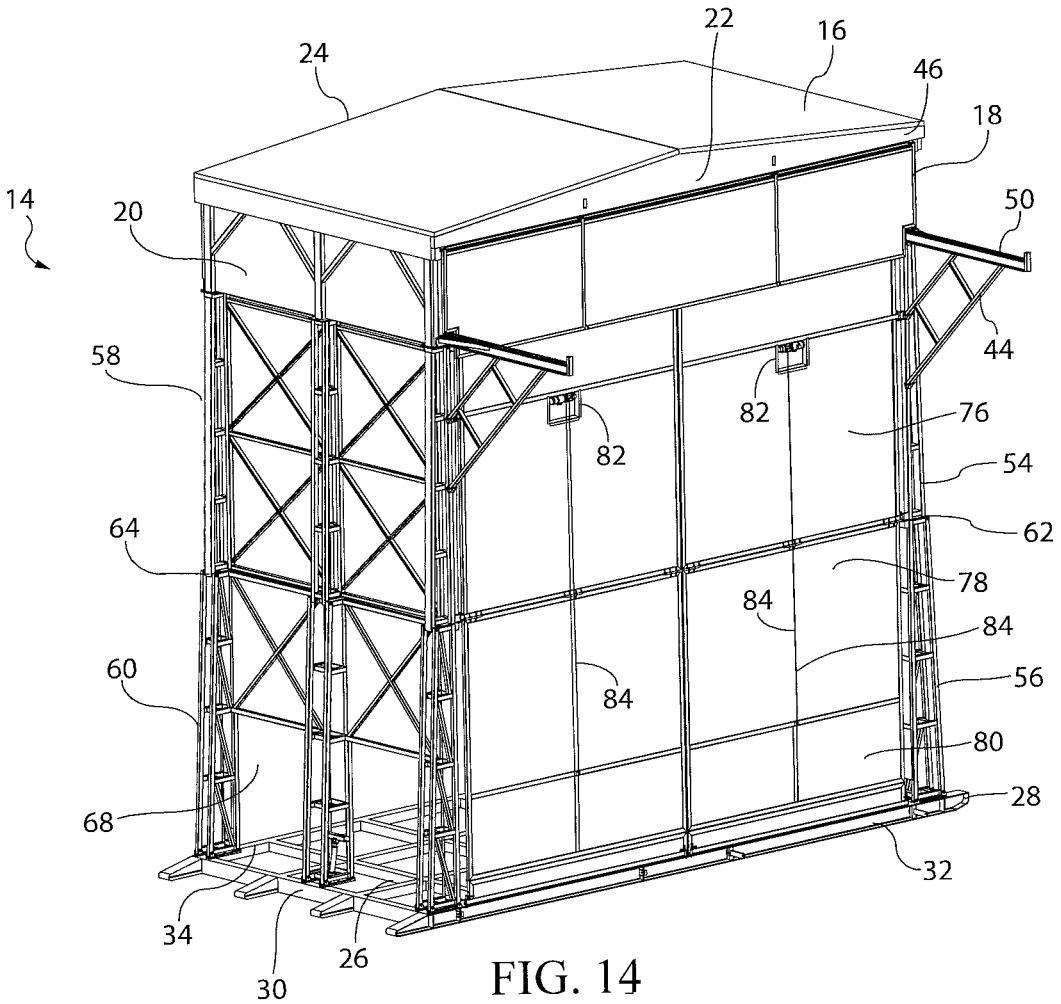
FIG. 14 is a front perspective view of a type of a building module of a collapsible modular building that is constructed in accordance with the principles of an embodiment of the present invention, illustrating the building module in an erect position and the doors in a closed, unfolded position.
Figure 15:
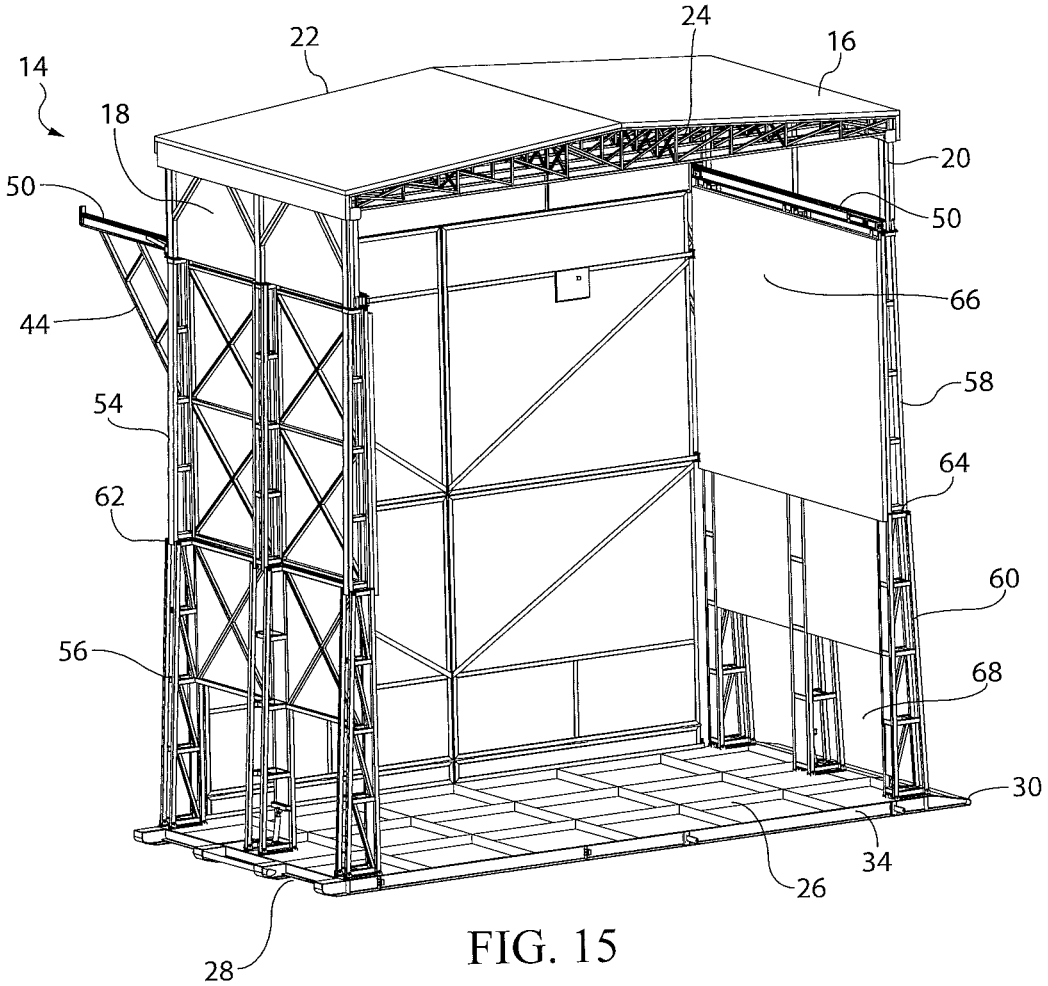
FIG. 15 is a rear perspective view of a type of a building module of a collapsible modular building illustrated in FIG. 13, illustrating the building module in an erect position and the doors in a closed, unfolded position.
Figure 16:
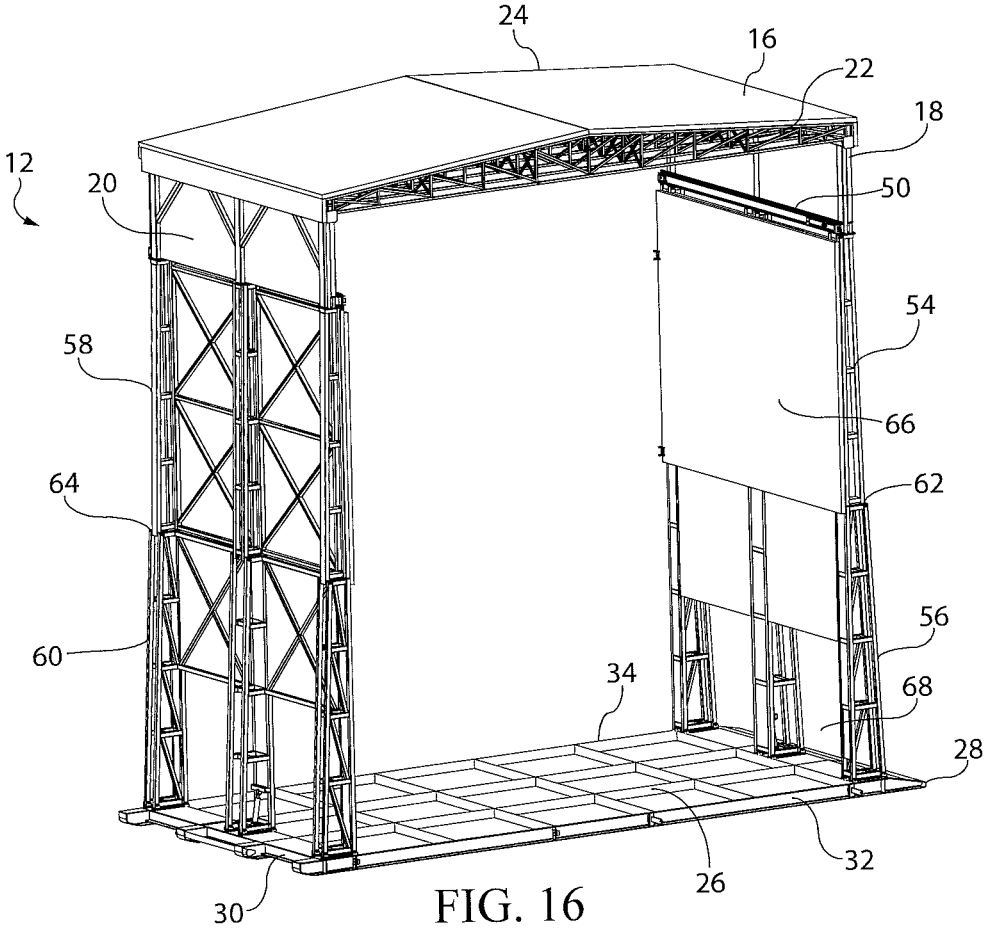
FIG. 16 is a perspective view of a type of a building module of a collapsible modular building that is constructed in accordance with the principles of an embodiment of the present invention, illustrating the building module in an erect position.

To place the first and second doors 72, 74 in an assembled position as shown in FIG. 13, the top panels 76 are swung into position along opening 70, perpendicular to the upper portions 54, 58 of each of the first and second articulated sidewalls 36, 38, best shown in FIGS. 9 and 10. Middle panel 78 is held into a stored position, shown in FIG. 10, by a clip 86. The top panels 76 include a winch 82, and a cable 84, wherein the winch 82 is disposed within the top panel 76 and tethered to the middle panel 78 by the cable 84. To place the middle panel 78 in the assembled position shown in FIG. 13, clip 86 is released and the winch 72 operates to lower the middle panel 78, by the cable 84, into position within the opening 70, illustrated in FIG. 12. Once the middle panel is positioned along the opening 70, the bottom panel 80 is then swung into place along the opening 70 by user, as illustrated in FIG. 13.

While modules 12, 14 are in collapsed position, the interior side of the lower portions 56, 60 of the articulated sidewalls 36, 38 are generally flat along the base 26, and the exterior of the upper portions 54, 58 of the articulated sidewalls 36, 38 are generally flat along the exterior of the respective lower portions 56, 60. This folded configuration is important in providing a compact design to aid in the shipping of the modules on trailers to alternate locations.

Figure 18:
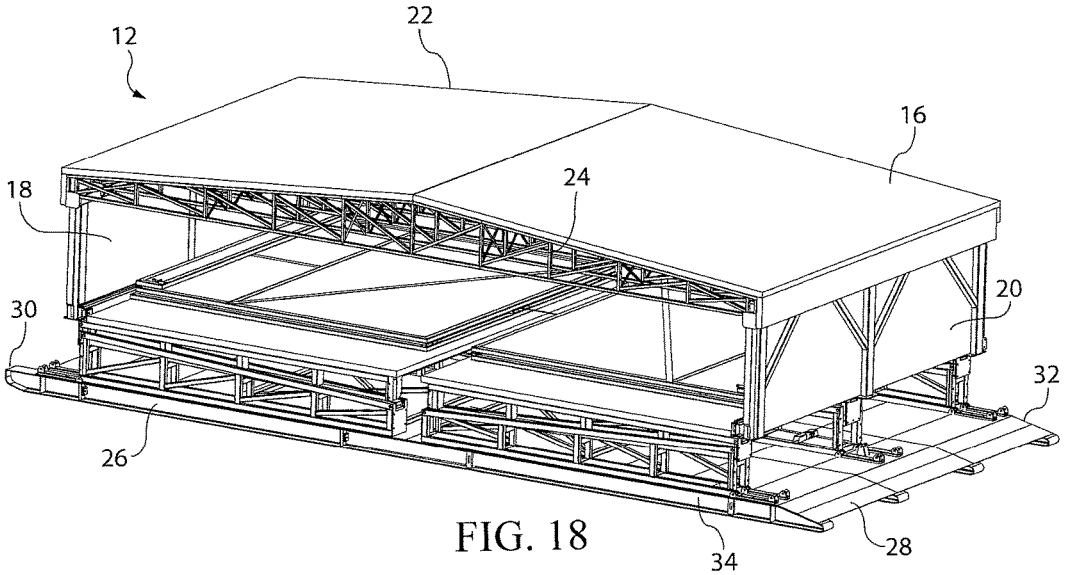
FIG. 18 is a perspective view of a type of a building module of a collapsible modular building that is constructed in accordance with the principles of an embodiment of the present invention, illustrating sidewalls and doors of the building module in a collapsed, transportable position.
Figure 19:
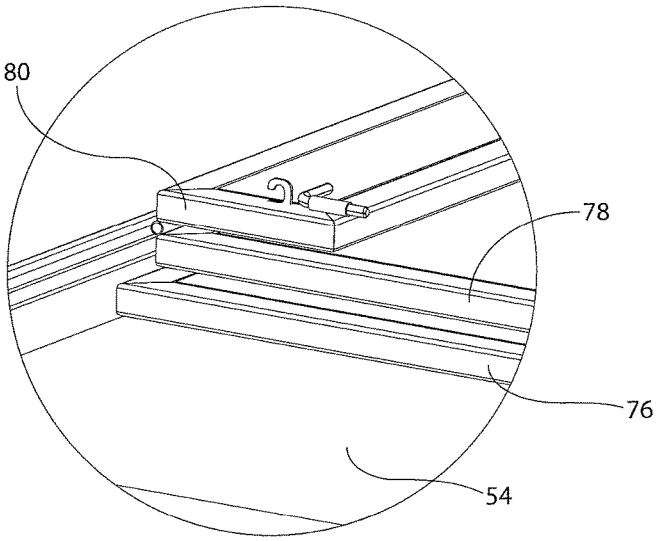
FIG. 19 is an enlarged partial perspective view of the exterior structure of the collapsible modular building that is constructed in accordance with the principles of an embodiment of the present invention, illustrating sidewalls and doors of the building module in a collapsed, transportable position.
Figure 20:
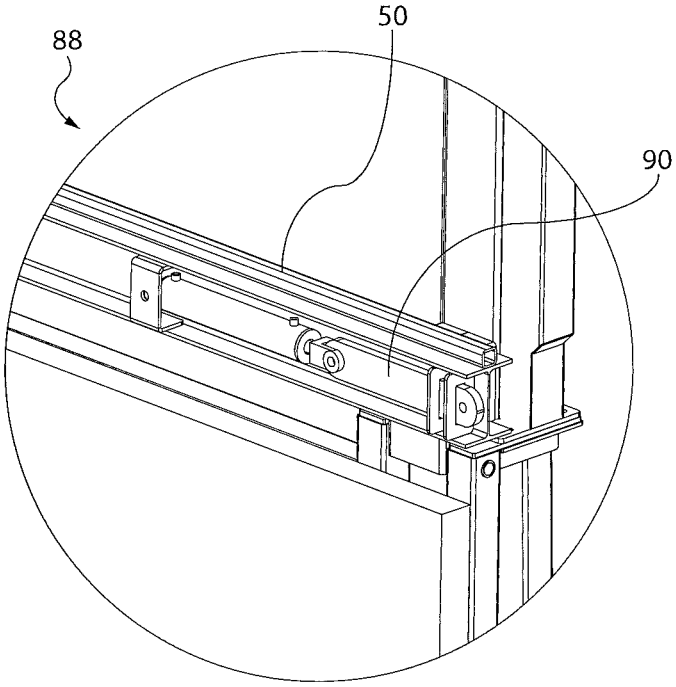
FIG. 20 is an enlarged partial perspective view of a pin and pull hydraulic system constructed in accordance with the principles of an embodiment of the present invention, illustrating the pin and pull hydraulic system in a retracted position.
Figure 21:
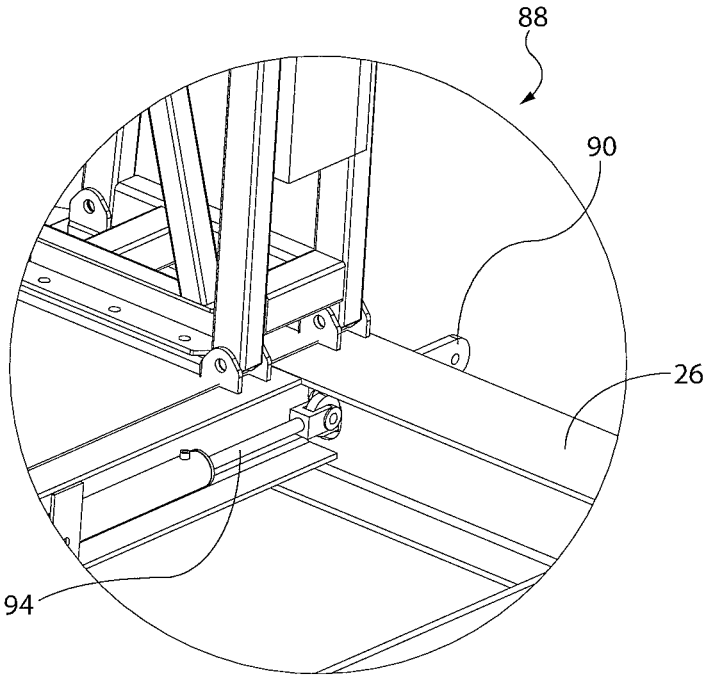
FIG. 21 is an enlarged partial perspective view of a male end of a pin and pull hydraulic system constructed in accordance with the principles of an embodiment of the present invention, illustrating the male end of the pin and pull hydraulic system in a retracted position.
Figure 22:
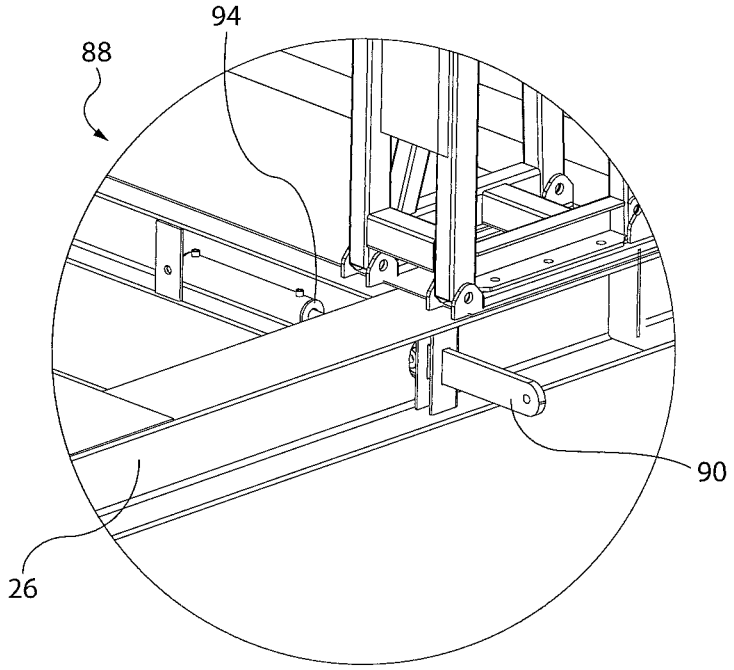
FIG. 22 is an enlarged partial perspective view of a male end of a pin and pull hydraulic system constructed in accordance with the principles of an embodiment of the present invention, illustrating the male end of the pin and pull hydraulic system in a retracted position.
Figure 23:
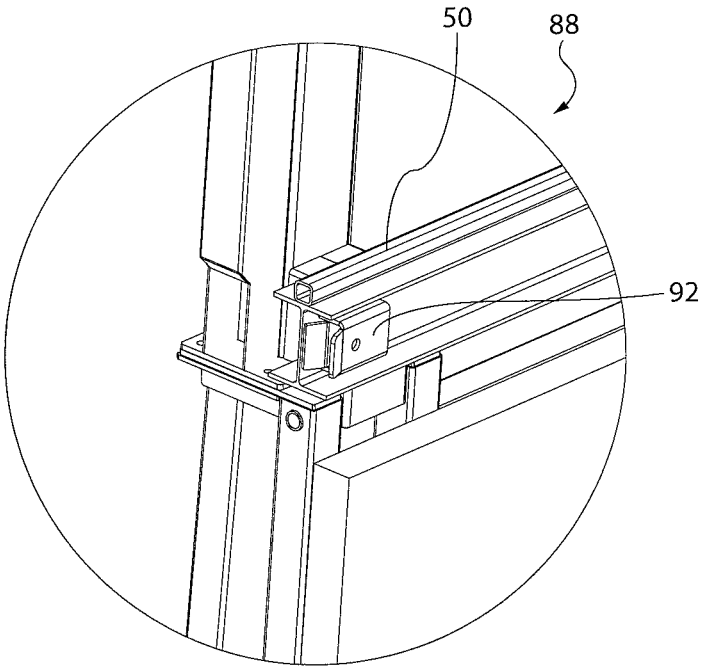
FIG. 23 is an enlarged partial perspective view of a female end of a pin and pull hydraulic system constructed in accordance with the principles of an embodiment of the present invention.

Specifically referring to the end module 14 in the collapsed position, the top panels 56 of each door 72, 74 are generally flat along the interior side of the upper portions 54, 58 of the articulated sidewalls 36, 38, the middle panels 78 are folded to be generally flat along the exterior of the top panels 76, and the bottom panels 80 are folded to be generally flat along the middle panels 78, best shown in FIGS. 18 and 19.

Figure 7:
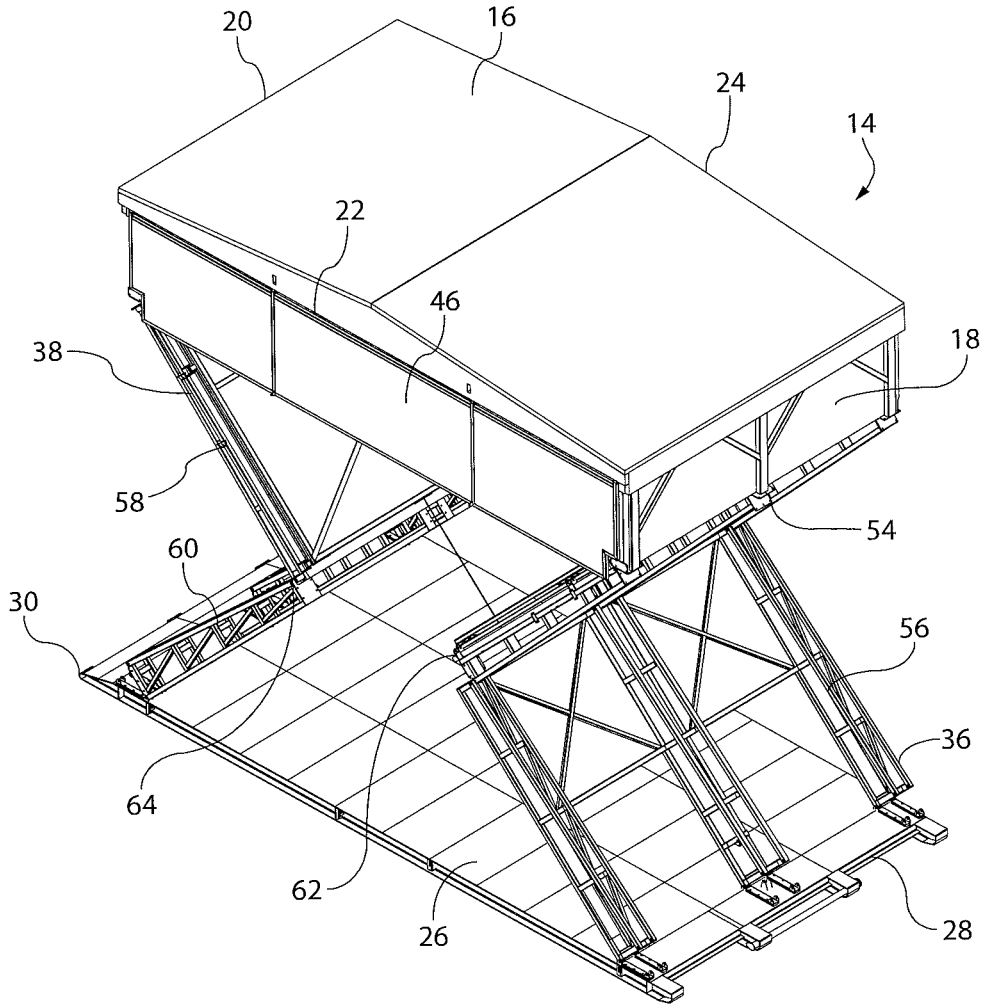
FIG. 7 is a perspective view of a type of a building module of a collapsible modular building that is constructed in accordance with the principles of an embodiment of the present invention, illustrating the building module in transition from a collapsed, transportable position to an erect position.

With the assistance of a portable crane, not shown in the figures, the modules 12, 14 can transition into the erect position, wherein the roof 16 is lifted vertically from the base 26, thereby causing the upper portions 54, 58 of each articulated sidewalls 36, 38 to unfold from the lower portions 56, 60 of each articulated sidewall 36, 38, shown in FIG. 7. The roof 16 continues to be lifted until the upper portions 54, 58 of each articulated sidewalls 36, 38 are parallel to the lower portions 56, 60 of each articulated sidewall 36, 38, thereby placing the modules 12, 14 into the erect position. To secure the modules 12, 14 into the erect position, a user bolts the respective upper and lower portions of the articulated sidewalls 36, 38 together, not shown in the figures, to prevent the articulated sidewalls 36, 3 from folding back to the collapsed position.

Referring now to FIGS. 20-25, each module 12, 14 further includes a pin and pull hydraulic system 88, for attaching adjacent modules 12, 14 to one another. The pin and pull hydraulic system 88, is located along the first and second lateral sides 32, 34 of the base 26 and along the crane rails 50 and includes a male attachment point 90 operatively attached to a hydraulic arm 94 and a female attachment point 92 configured to receive the male attachment point 90, wherein the female attachment point 92 is positioned adjacent to the male attachment point 90 when the modules 12, 14 are positioned side-by-side. Additionally, alignment lugs 96 can be placed along the first and second lateral sides 32, 34, to assist in aligning the base 26 of the modules 12, 14 as they are pulled together.

To attach an end module 14 to a central module 12, or some combination therein, a user first must position the modules alongside the other. To position the male attachment point 90 within the female attachment point 92, the hydraulic arm 94 is extended, wherein the male attachment point 90 is secured to the female attachment point 92 by a fastener such as a bolt or pin. Once the modules are secured via the attachment points 90, 92, the hydraulic arm 94 is retracted, thereby drawing the separate modules together.

To transition the modules 12, 14 back into the collapsed position, the bottom panels 80 of doors 72, 74 are folded back into position along the interior face of the middle panels 78, wherein the middle panels 78 are then retracted by the respective winches 82 and secured into place along the exterior of the top panels 76 by the clip 86, and the doors 72, 74 are positioned along the interior side of the upper portions 54, 58 of the articulated sidewalls 36, 38. Once the doors are in place, the articulated sidewalls 36, 38, the portable crane lifts the roof 16 to allow a user to remove the bolts securing the first and second articulated sidewalls 36, 38 in the erect position. The articulated sidewalls 36, 38 then fold back into the collapsed position. To assist with folding the modules 12, 14 back into the collapsed position, hydraulic rams, not shown, can be positioned within the sidewalls to slow the collapsing of the sidewalls preventing damage to the modules 12, 14 and injury to the user.

Figure 24:
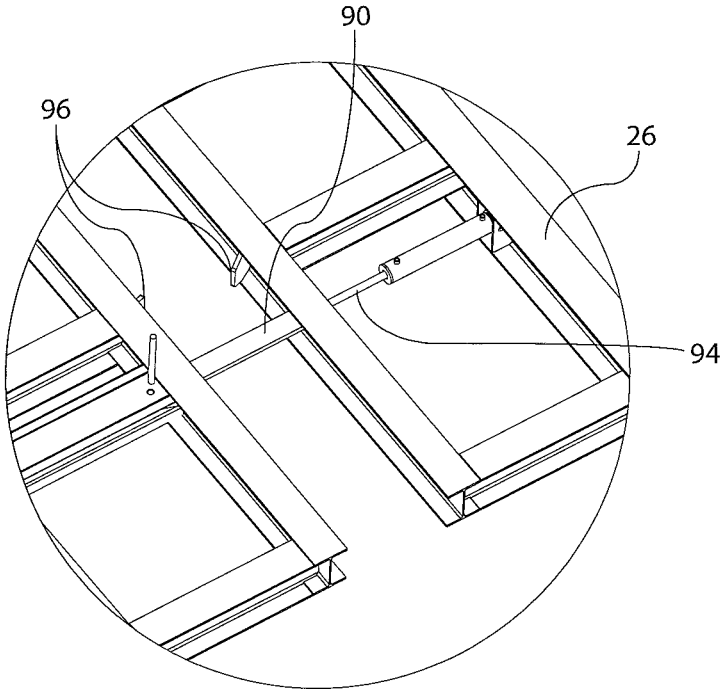
FIG. 24 is an enlarged view of a pin and pull hydraulic system illustrated in FIGS. 20-23, and constructed in accordance with the principles of an embodiment of the present invention.
Figure 25:
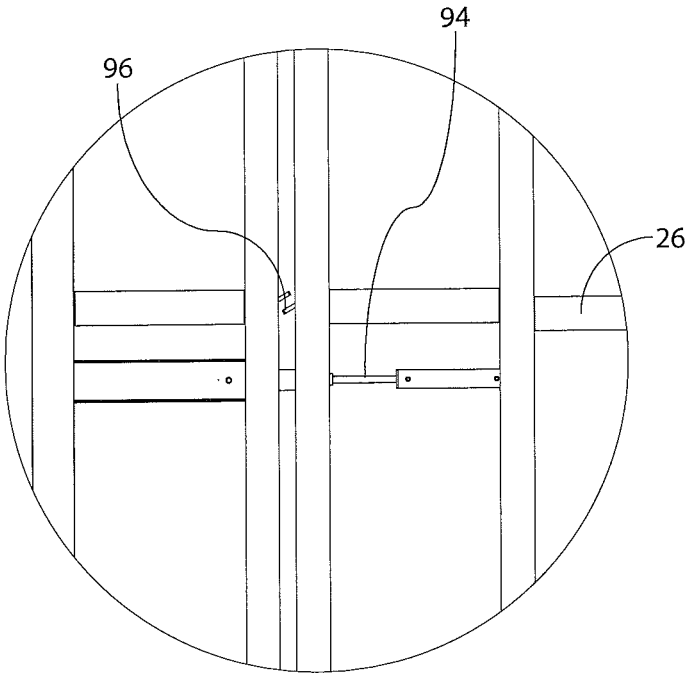
FIG. 25 is an enlarged view of a pin and pull hydraulic system illustrated in FIGS. 20-23, and constructed in accordance with the principles of an embodiment of the present invention, illustrating alignment lugs in use.

Referring now to FIGS. 26-33 of the drawings, and more particularly to FIGS. 24 and 25, shown therein and designated by reference number 100 is a collapsible modular building that is constructed in accordance with an alternative embodiment of the present invention. The collapsible modular building 100 is constructed of several building modules and configured to be transitioned from a collapsed position to an erect position, or vice versa.

The collapsible modular building 100 includes first and second building modules 102, 104 each including a telescoping sidewall 106, a roof 108 having first and second longitudinal sides 110, 112, and first and second lateral sides 114, 116, and a base 117 having first and second longitudinal sides 120, 122 and first and second lateral sides 124, 126. The roof 108 and the base 118 of building modules 102, 104 are each configured to include one half of the complete roof structure and base structure of the collapsible modular building 100. The building module 102 is designed and constructed to identically mirror the building module 104 so that when attached to one another, the building modules 102, 104 form a complete collapsible modular building 100.

Figure 26:
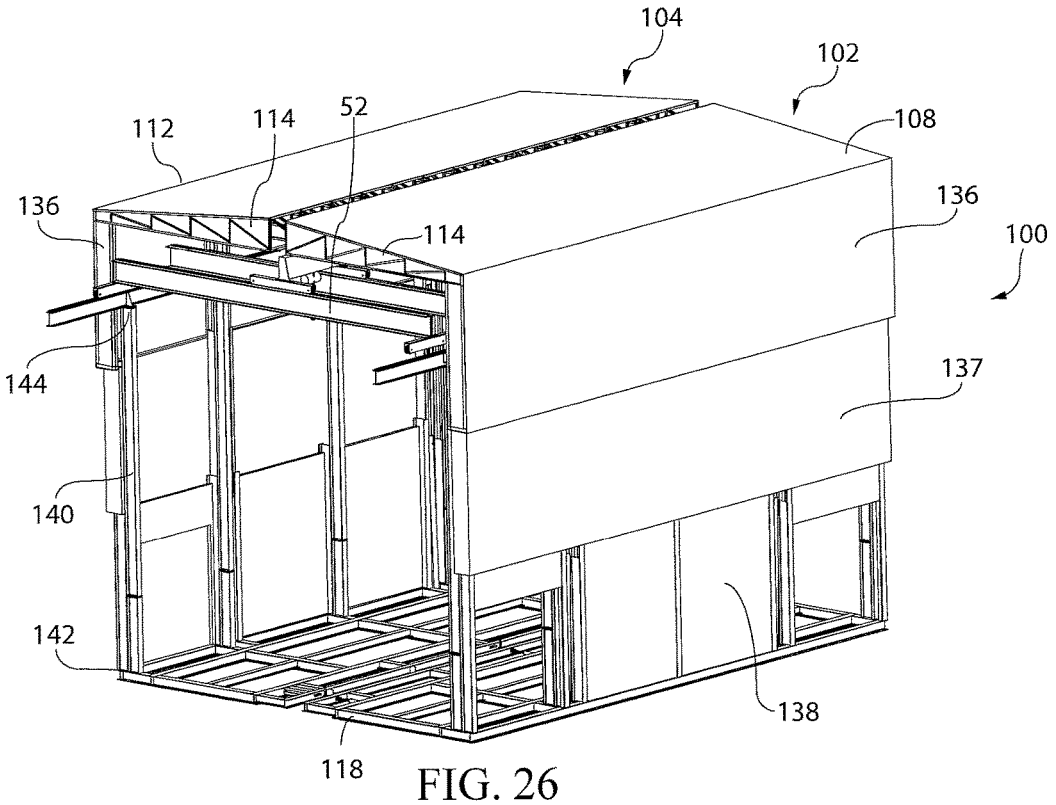
FIG. 26 is a perspective view of a collapsible modular building that is constructed in accordance with the principles of an alternative embodiment of the present invention, illustrating the collapsible modular building assembled in an erect position.
Figure 27:
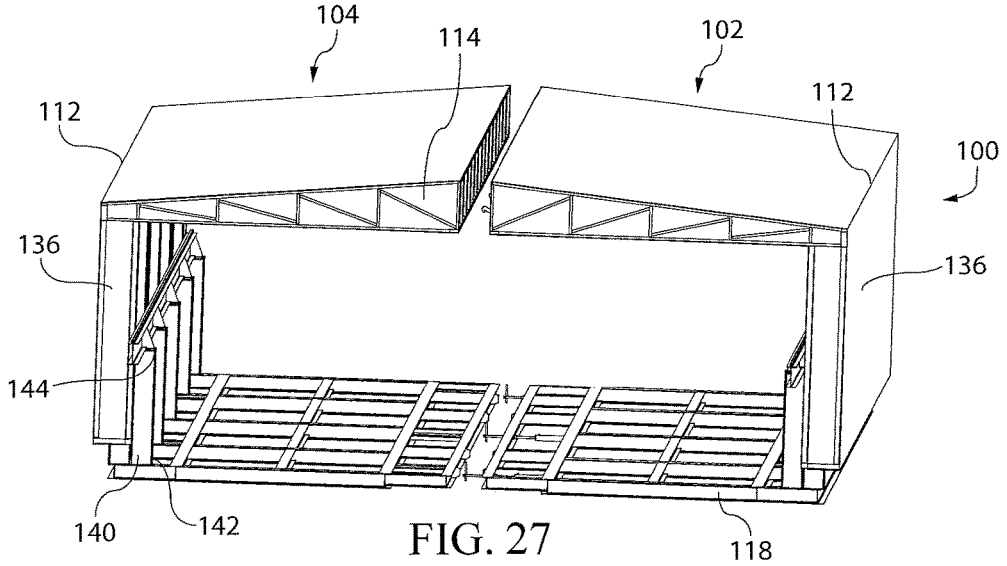
FIG. 27 is a perspective view of a collapsible modular building constructed in accordance with the principles of an alternative embodiment of the present invention, illustrating the collapsible modular building partially assembled in a collapsed position.

To transition the building modules 102, 104 into the collapsible modular building 100, the building modules 102, 104 must be attached together. This ensures the building modules 102, 104 are properly supported and capable of withstanding wind or other forces of nature once the collapsible modular building 100 is in the erect position, as shown in FIG. 26.

The base 118 of the building modules 102, 104 are attached to one another using the pin and pull hydraulic system 88 as described above and illustrated in FIGS. 20-25. The roof 118 of the building module 102, 104 can be secured using the pin and pull hydraulic system 88, however in the depicted embodiment, an alternative system is used.

In the depicted embodiment, roof 108 includes at least one latch hook attachment system 128, located along the first longitudinal side 110. The latch hook attachment system 128 includes a hook 130, attachment point 132, and a hydraulic arm 134, wherein for example, at least one hook 130 and one hydraulic arm 134 are located on the first building module 102 and the attachment point 132 is located on the second building module 104 in a location capable of receiving the hook 130.

Figure 28:
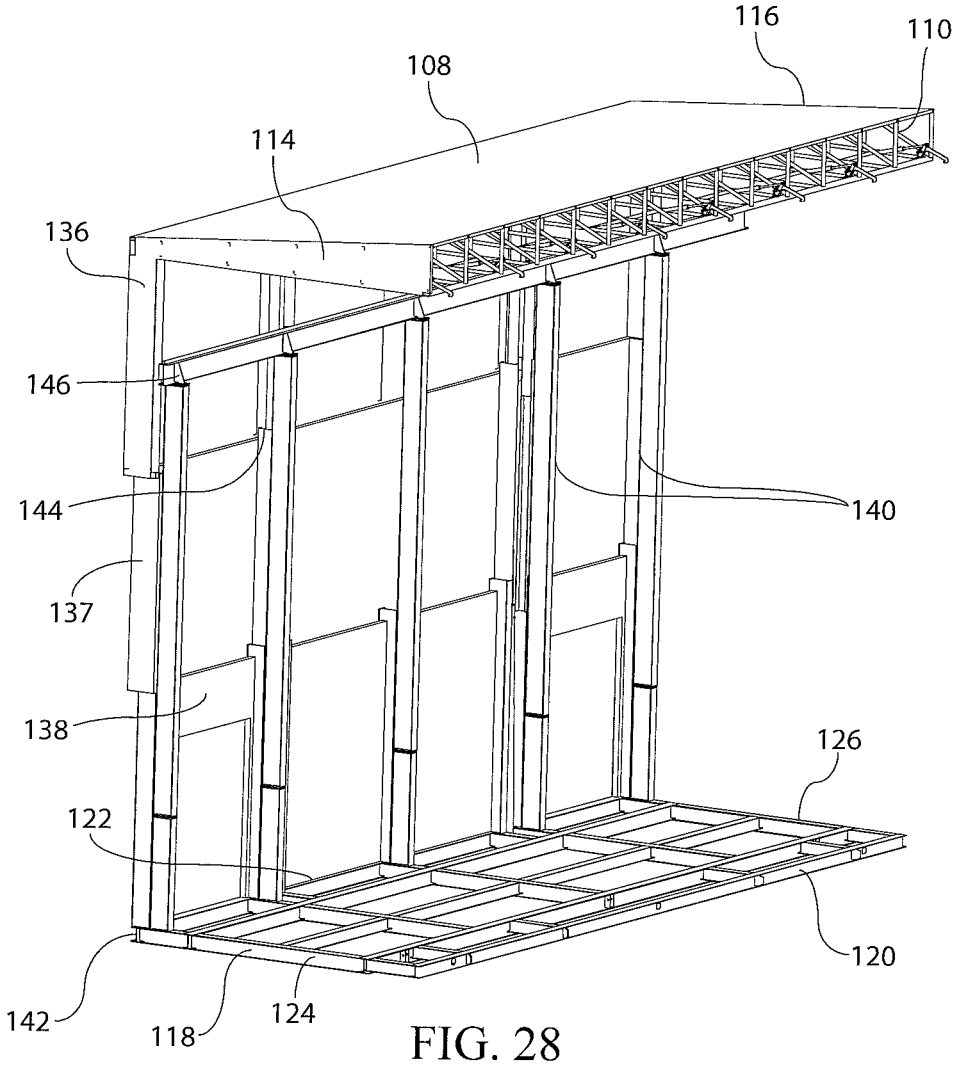
FIG. 28 is a perspective view of a building module of a collapsible modular building that is constructed in accordance with the principles of an alternative embodiment of the present invention, illustrating the building module in an erect position.
Figure 29:
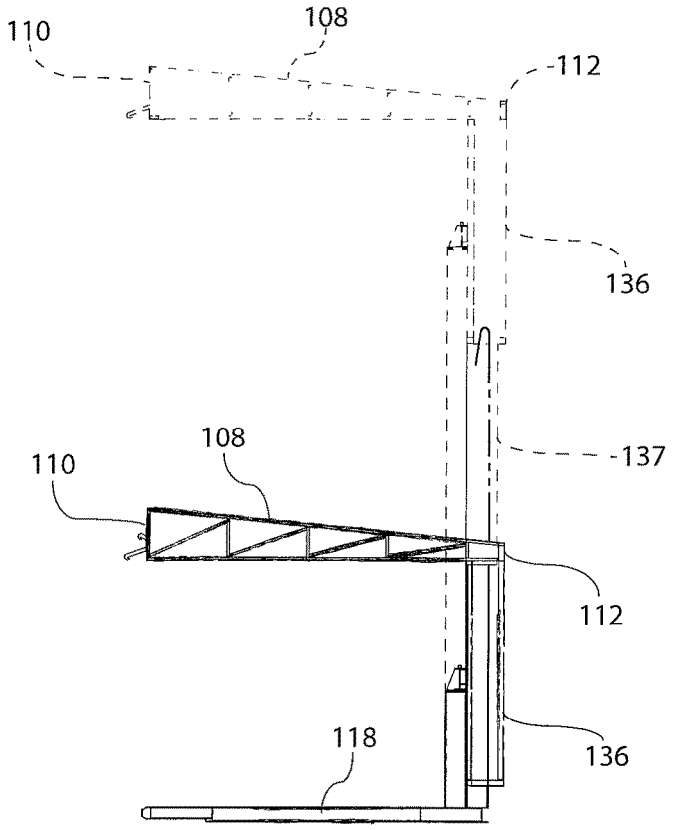
FIG. 29 is a front elevation view of a building module of a collapsible modular building that is constructed in accordance with the principles of an alternative embodiment of the present invention, illustrating the building module in a collapsed position and an erect position in phantom.
Figure 30:
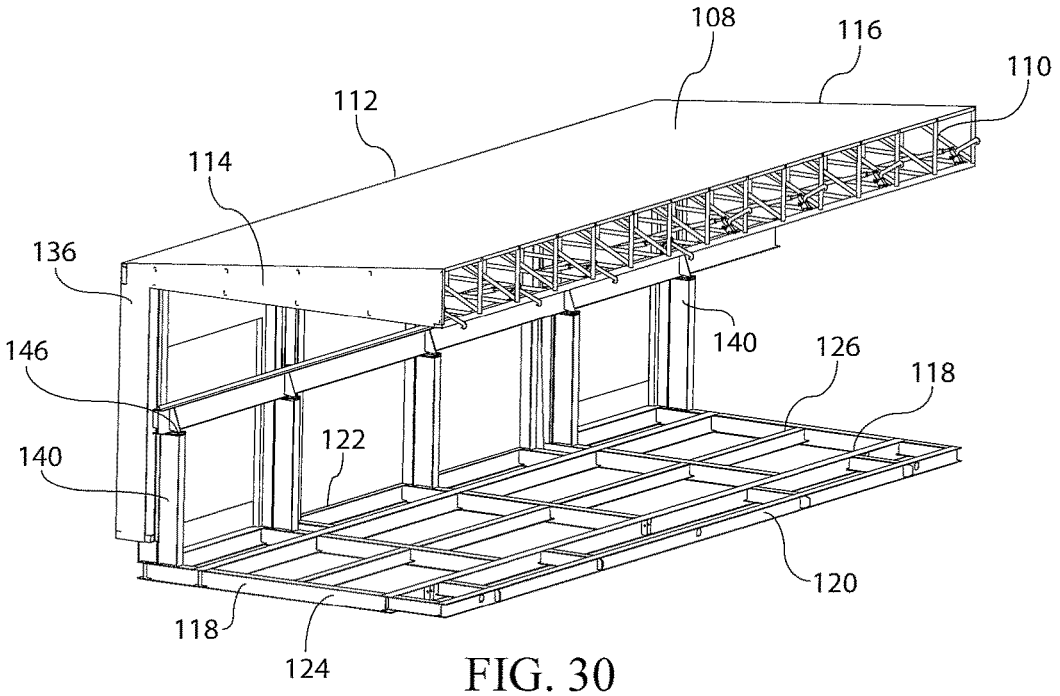
FIG. 30 is a perspective view of a building module of a collapsible modular building that is constructed in accordance with the principles of an alternative embodiment of the present invention, illustrating the building module in a collapsed position.
Figure 31:
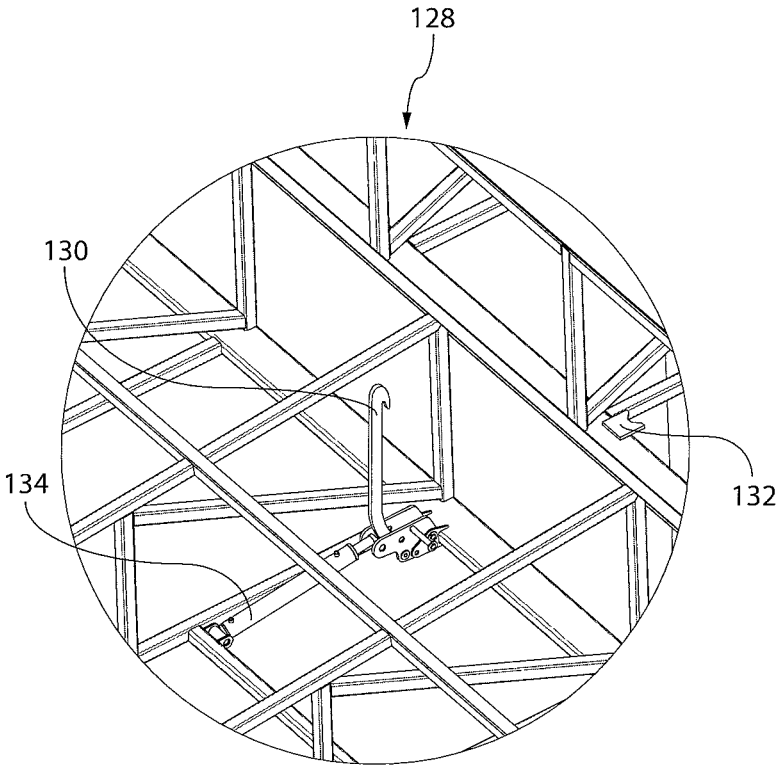
FIG. 31 is an enlarged view of a roof latch of a collapsible modular building that is constructed in accordance with the principles of an embodiment of the present invention, illustrating the roof latch in a retracted position.
Figure 32:
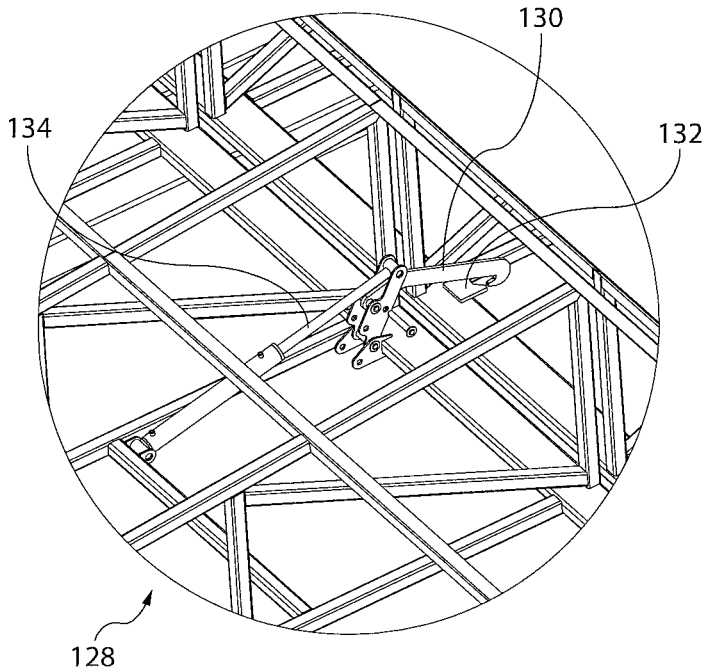
FIG. 32 is an enlarged view of a roof latch of a collapsible modular building that is constructed in accordance with the principles of an embodiment of the present invention, illustrating the roof latch in an engaged position.

The telescoping sidewall 106 of the building modules 102, 104 includes an upper panel 136, a middle panel 137, a lower panel 138, and telescoping columns 140. Each telescoping column 140 include a first end 142 attached to base 118 and a second end 144 attached to a plate 160 that is attached to and disposed at an intermediate location 146 along an interior of the top panel 136. The second longitudinal side 112 of roof 108 is attached to and secured along top panel 136. The telescoping columns 140 are configured to telescopically collapse or extend to facilitate the transitions between the collapsed position and the erect position, as best shown in FIGS. 28-30. The top panel 136 is configured to have dimensions large enough to receive the middle panel 137, and the middle panel 137 is configured to have dimensions large enough to receive the bottom panel 138. Thus when the building modules 102, 104 are in the collapsed position, the middle panel 137 and bottom panel 138 are pocketed within the top panel 136.

Figure 33:
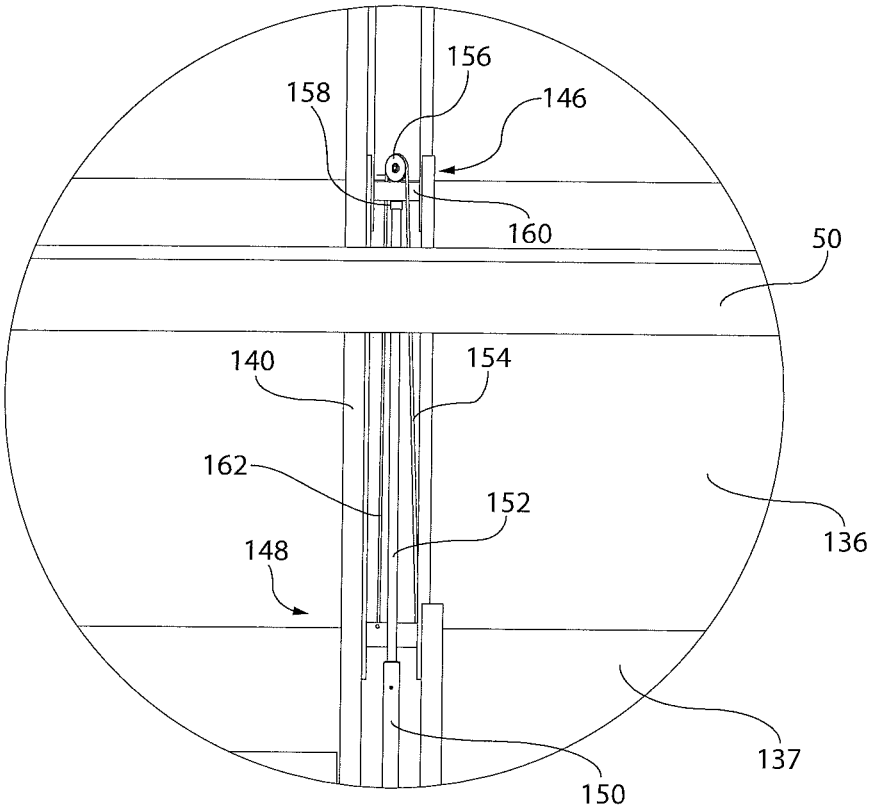
FIG. 33 is an enlarged view of a lift system of a collapsible modular building that is constructed in accordance with the principles of an embodiment of the present invention.

Referring now to FIG. 33, the at least two of columns 140 of the building modules 102, 104 include a hydraulic lifting system 148 that includes a hydraulic cylinder 150, hydraulic lifting arm 152 having a lifting end 158, a cable lift 154, and a pulley 156 which operate to transition the collapsible modular building 100 from the collapsed position to the erect position. The hydraulic cylinder 150 is secured to the base 118 and positioned within column 140, along the interior of bottom panel 138. In the collapsed position, the hydraulic arm 152 is disposed within the hydraulic cylinder 150, wherein the lifting end 158 of the hydraulic arm 152 is pressed against the lifting plate 160.

The lifting cable 154 is secured to the base 118 (not shown), and extends from the base 118, around the pulley 156 that is attached to the lifting plate 160, to the cable attachment point 162 located atop the middle panel 102. When the hydraulic lifting system 148 is activated, the hydraulic lifting arm 152 is pressed vertically up from the hydraulic cylinder 150 against the lifting plate 160, thereby lifting the top panel 136 and the roof 108 vertically from the base 118 and vertically extending the columns 140. As the top panel 136 moves vertically, the cable 154 becomes taut and pulls the middle panel 137 vertically towards the pulley 156.

The collapsible modular building 100 further includes an overhead crane 52 and crane rails 50, wherein each building module 102, 104 each contains a single continuous crane rail 150 that extends longitudinally along the interior of the top panel 136 of the building module 102, 104 and is attached to and supported by the top 144 of the columns 140. The crane 52 extends from the crane rail 50 of the building module 102 to the crane rail 50 of the building module 104, as depicted in FIG. 26. The crane rail 50 can be designed to extend beyond the first lateral side 114 of the building module 102, 104 to allow the crane 52 to operate outside the collapsible modular building 100.

A number of embodiments of the present invention have been described. Nevertheless, it will be understood that various modifications may be made without departing from the spirit and scope of the invention and the following claims.

What is claimed is:

1. A collapsible modular building comprising:

at least two building modules connected to one another and forming a building; each of said at least two building modules comprising:

a base having opposite first and second longitudinal sides and opposite first and second lateral sides;

a roof having opposite first and second longitudinal sides and opposite first and second lateral sides;

a first articulated wall connected to and extending between said base and said roof and extending along said first longitudinal sides of said base and said roof;

a second articulated wall connected to and extending between said base and said roof and extending along said second longitudinal sides of said base and said roof; and wherein each of said first and said second articulated walls fold in a direction inwardly toward one another into a collapsed position and move said roof toward said base and fold in a direction outwardly from one another into an extended position and move said roof away from said base;

wherein said roof of each said at least two building modules are connected together and said base of each of said at least two building modules are connected together;

wherein each of said at least one of said at least two building modules further comprises a first and a second door, said first door is hingedly attached along an upper wall section of said first articulated wall, said second door is hingedly attached along an upper wall section of said second articulated wall, and said first and second doors extend between said first and second articulated sidewalls along said first lateral side of said base and said first lateral side of said roof;

wherein said first and said second doors include a top panel, a middle panel, and a bottom panel, wherein said middle panel is hingedly connected to said top panel and said bottom panel on opposite sides of said middle panel;

wherein the modular building further comprises a first and second winches, each having an extensible cable;

said first winch attached to said top panel of said first door and said cable of first winch operatively connected to said middle panel of said first door; and said second winch attached to said top panel of said second door and said cable of said second winch operatively connected to said middle panel of said second door.

2. A building module for use in constructing a modular building, said building module comprising:

a base having opposite first and second longitudinal sides and opposite first and second lateral sides;

a roof having opposite first and second longitudinal sides and opposite first and second lateral sides;

a first articulated wall connected to and extending between said base and said roof and extending along said first longitudinal sides of said base and said roof;

a second articulated wall connected to and extending between said base and said roof and extending along said second longitudinal sides of said base and said roof; and wherein each of said first and said second articulated walls fold in a direction inwardly toward one another into a collapsed position and move said roof toward said base and fold in a direction outwardly from one another into an extended position and move said roof away from said base;

a first and second door;

wherein said first door is hingedly attached along an upper wall section of said first articulated wall and said second door is hingedly attached along an upper wall section of said second articulated wall;

said first and second doors extend between said first and second articulated sidewalls along said first lateral side of said base and said first lateral side of said roof;

wherein said first and said second doors include a top panel, a middle panel, and a bottom panel, wherein said middle panel is hingedly connected to said top panel and said bottom panel on opposite sides of said middle panel;

wherein the modular building further comprises a first and second winches, each having an extensible cable;

said first winch attached to said top panel of said first door and said cable of first winch operatively connected to said middle panel of said first door; and said second winch attached to said top panel of said second door and said cable of said second winch operatively connected to said middle panel of said second door.

3. The building module of claim 2, wherein said upper wall section of each of said first and second articulated walls being hingedly connected to a lower wall section along adjoining ends such that said upper wall section and said lower wall section rotate toward and away from one another between a said collapsed position and said extended position.

4. The collapsible modular building of claim 3, wherein said upper wall section is hingedly connected to said roof and said lower wall section is hingedly connected to said base.

5. The collapsible modular building of claim 2, further comprising:

a first crane rail extending along said first longitudinal side of said roof;

a second crane rail extending along said second longitudinal side of said roof; and a crane operatively supported by said first crane rail and said second crane rail.

* * * * *